US009962741B2

(12) United States Patent
Schneider et al.

(10) Patent No.: US 9,962,741 B2
(45) Date of Patent: May 8, 2018

(54) COMPACT DEDUSTING APPARATUS WITH REMOTE DISCHARGE

(71) Applicant: Pelletron Corporation, Lancaster, PA (US)

(72) Inventors: Heinz Schneider, Lancaster, PA (US); Joseph T. Lutz, West Chester, PA (US)

(73) Assignee: Pelletron Corporation, Lancaster, PA (US)

( * ) Notice: Subject to any disclaimer, the term of this patent is extended or adjusted under 35 U.S.C. 154(b) by 0 days. days.

(21) Appl. No.: 15/282,462

(22) Filed: Sep. 30, 2016

(65) Prior Publication Data

US 2018/0093302 A1 Apr. 5, 2018

(51) Int. Cl.

| | |
|---|---|
| ***B03B 1/00*** | (2006.01) |
| ***B07B 4/02*** | (2006.01) |
| ***B07B 11/02*** | (2006.01) |
| ***B07B 11/06*** | (2006.01) |

(52) U.S. Cl.
CPC ..... *B07B 4/02* (2013.01); *B07B 11/02* (2013.01); *B07B 11/06* (2013.01)

(58) Field of Classification Search
CPC ..... B07B 4/02; B07B 11/02; B07B 11/06
USPC ..... 209/3
See application file for complete search history.

(56) References Cited

U.S. PATENT DOCUMENTS 3,679,101 A * 7/1972 Aldridge ..... B01F 15/0219 222/136
3,693,320 A * 9/1972 Garland ..... A61J 3/07 134/32
3,708,926 A * 1/1973 Fogle ..... B24C 3/062 451/456
3,926,788 A * 12/1975 Stephens ..... B01D 46/02 209/250
4,251,356 A * 2/1981 Harte ..... A24B 1/04 209/143
4,737,269 A * 4/1988 Bischoff ..... B07B 9/00 209/137
5,035,331 A * 7/1991 Paulson ..... B07B 4/02 15/1.51
5,794,847 A * 8/1998 Stocker ..... A01G 13/065 239/171

(Continued)

FOREIGN PATENT DOCUMENTS

WO PCT/KR2013/002924 11/2013

*Primary Examiner* — Terrell H Matthews
(74) *Attorney, Agent, or Firm* — Miller Law Group, PLLC

(57) ABSTRACT

A compact dedusting apparatus induces air flow through the housing by a vacuum generator mounted within the housing. The discharge of dust and debris can be passed through a conduit to a remote location without losing air flow velocity to facilitate the use of the compact dedusting apparatus within a clean room. The metering device is formed from stainless steel and mounted on a spring-loaded mounting plate to permit vertical movement of the metering device when a jam of the particulate material is encountered. The metering device can be driven by a low torque stepper motor operable at selectively variable speeds to control the flow rate of the particulate material. The discharge transition is formed with an enlarged cross-sectional area compared to the shape of the Venturi zone so that carryover pellets can be returned to the product flow instead of being lost with the dirty air discharge.

25 Claims, 7 Drawing Sheets

(56) References Cited

U.S. PATENT DOCUMENTS

| | | | | |
|---|---|---|---|---|
| 6,595,369 | B2 * | 7/2003 | Paulson | B07B 4/02<br>209/137 |
| 7,083,069 | B2 * | 8/2006 | Wysong | A01C 7/122<br>222/129 |
| 7,380,670 | B2 * | 6/2008 | Paulson | B07B 7/00<br>209/133 |
| 2002/0152636 | A1 * | 10/2002 | Ernst | B08B 6/00<br>34/487 |
| 2015/0216106 | A1 * | 8/2015 | Kotte | A01C 1/08<br>47/58.1 R |

* cited by examiner

COMPACT DEDUSTING APPARATUS WITH REMOTE DISCHARGE

FIELD OF THE INVENTION

The invention disclosed in this application is directed generally to the cleaning and handling of particulate materials, such as plastic pellets, regrind, tablets, grains, minerals, and the like, and particularly to a dedusting apparatus that is compactly configured to induce air flow therethrough to clean the particulate materials from dust and debris carried therewith and to provide the capability to discharge the collected dust and debris to a remote location to preserve the status of a clean room.

BACKGROUND OF THE INVENTION

It is well known, particularly in the field of transporting and using particulate materials, commonly coarse powders, granules, pellets, and the like that it is important to keep product particles as free as possible of contaminants. Particulates are usually transported within a facility where they are to be mixed, packaged or used in a pressurized tubular system that in reality produces a stream of material that behaves somewhat like a fluid. As these materials move through the pipes, considerable friction is generated not only among the particles themselves, but also between the tube walls and the particles in the stream. In turn, this friction results in the development of particle dust, broken particles, fluff, and streamers (ribbon-like elements that can "grow" into quite long and tangled wads that will impede the flow of materials or even totally block the flow). The characteristics of such a transport system are quite well known, as is the importance and value of keeping product particles as free as possible of contaminants.

The term "contaminant" as used herein includes a broad range of foreign material, as well as the broken particles, dust, fluff and streamers mentioned in the preceding paragraph. In any case, contaminants are detrimental to the production of a high quality product, and in some situations a health risk to employees of the producer and possibly even a source of danger in that some contaminants can produce a dust cloud which, if exposed to an ignition source, may explode.

Considering product quality, and focusing on moldable plastics as a primary example, foreign material different in composition from the primary material, such as dust, non-uniform material of the primary product, fluff, and streamers, does not necessarily have the same melting temperatures as the primary product and causes flaws when the material is melted and molded. These flaws result in finished products that are not uniform in color, may contain bubbles, and often appear to be blemished or stained, and, therefore, cannot be sold. Heat in the injection molding machine can vaporize dust that leads to tiny gas bubbles in the finished product. Heat also burns dust and causes "black spots", actually carbonized dust. Sometimes dust pockets in the machine don't melt and cause "soft spots" or "white spots" as these defects are commonly called. It is important to note that, since these same non-uniform materials often do not melt at the same temperature as the primary product, the un-melted contaminants cause friction and premature wear to the molding machines, resulting in downtime, lost production, reduced productivity, increased maintenance and, thus, increased overall production costs.

Conventional particulate material dedusting devices, such as is disclosed in U.S. Pat. No. 5,035,331, granted to Jerome I. Paulson on Jul. 30, 1991, utilize first and second wash decks, formed as sloped planar surfaces within the apparatus and having openings therein for the passage of pressurized air therethrough to pass through particulate material flowing along the wash decks. Between the two wash decks, the particulate material passes through a Venturi zone, which combined with the passage of air through the particulate material on the wash decks, discharges dust and other contaminates upwardly with the air flow to be discharged from the apparatus.

In U.S. Pat. No. 7,380,670, granted on Jun. 3, 2008, to Jerome I. Paulson, Heinz Schneider and Paul Wagner, a compact dedusting apparatus having back-to-back wash deck assemblies, provides increased capacity by doubling the wash decks and the Venturi zones, which requires the inflow of particulate material to be equally divided between the two wash deck assemblies. In both U.S. Pat. No. 5,035,331 and U.S. Pat. No. 7,380,670, a magnetic flux field is applied to the infeed of particulate material to neutralize the static charges attracting the contaminates to the particulate pellets to enhance the operation of the wash decks in separating contaminates from the particulate material.

Uniceltec, a Korean Corporation, developed and marketed a compact dedusting apparatus disclosed in PCT Patent Application No. PCT/KR2013/002924, filed on Apr. 8, 2013, by Joong Soon Kim, et al. This compact dedusting apparatus, with appropriate improvements to meet the demands of the U.S. market, has been marketed in the U.S. by Pelletron Corporation as the Model C-20 dedusting apparatus. Applicants have made significant additional improvements to the Model C-20 dedusting apparatus and desire to protect such improvements by way of this patent application.

Among the problems found in the presently marketed C-20 dedusting apparatus as developed by Uniceltec is the provision of a urethane metering device that wears through engagement with the particulate materials and adds a corresponding amount of dust into the flow of particulate material to be cleaned. The Model C-20 dedusting apparatus has the capability of being utilized in a clean room, i.e. a room in which ambient dust is not permitted due to the particular operation being conducted within the clean room. The previous model of this compact dedusting apparatus developed in Korea by Uniceltec utilized a compressed air powered vacuum generator to provide cleaning of the particulate material, which requires discharge from the dedusting apparatus, even if passed through a dust collection apparatus. This arrangement does not permit the remote discharge of the collected dust and debris and the air flow. Lastly, the dedusting apparatus developed by Uniceltec had a problem with carryover of particulate material with the discharged dust and debris, resulting in a loss of particulate material.

Accordingly, it would be desirable to provide a compact dedusting apparatus that would solve the problems of the previously developed Uniceltec dedusting apparatus, particularly to be capable of utilization within a clean room.

SUMMARY OF THE INVENTION

It is an object of this invention to provide a compact dedusting apparatus for use in clean rooms to clean particulate material, such as plastic pellets, to remove dust and debris therefrom.

It is another object of this invention to provide a compact dedusting apparatus that solves the known problems of the previously developed compact dedusting apparatus.

It is a feature of this invention that air flow is induced through the compact dedusting apparatus by a vacuum.

It is another feature of this invention that the vacuum generator inducing a flow of air through the compact dedusting apparatus by a vacuum is located in the housing for the compact dedusting apparatus and is large enough to permit remote positioning of the dust collection apparatus.

It is an advantage of this invention that the positioning of the vacuum generator in the housing of the dedusting apparatus that the dust collection apparatus can be remotely located relative to the dedusting apparatus without diminishing air flow through the dedusting apparatus.

It is still another feature of this invention that the shape of the discharge transition between the Venturi chamber within the dedusting apparatus and the dirty air discharge port has been enlarged to provide a larger cross-section area.

It is another advantage of this invention that the enlarged cross-sectional area of the discharge transition operates to slow the speed of the air flow within the discharge transition.

It is still another advantage of this invention that the slowed air flow speed within the enlarged discharge transition allows the heavier carryover plastic pellets being carried with the dust and debris toward the dirty air discharge opening to drop out of the air flow toward the cleaned product material discharge opening while the collected dust and debris continue toward the dirty air discharge opening.

It is yet another feature of this invention that the metering device is formed from stainless steel instead of urethane.

It is yet another advantage of this invention that the stainless steel metering device does not wear from engagement with plastic particulates and does not add an addition measure of dust to the flow of particulate material to be cleaned therefrom.

It is still another feature of this invention that the metering device is mounted on a spring-loaded mounting plate to allow the metering device to move vertically when encountering a jam of particulate pellets.

It is a further feature of this invention that the vertical movement of the metering device is stopped when the mounting plate engages a stop mechanism to prevent the metering device from striking the floor of the infeed opening and engaging and breaking the particulate material flowing along the floor.

It is a further advantage of this invention that the metering device can be operated by a low torque motor to lower costs of manufacturing the dedusting apparatus.

It is still a further advantage of this invention that the low torque motor can operate the metering device at selectable variable speeds of rotation to vary the rate of particulate material flowing through the dedusting apparatus.

It is yet a further feature of this invention that ionization pins can be mounted in the compact dedusting mechanism within the flow of particulate material passing through the metering device to induce negative ions onto the plastic pellets to separate microscopic dust particles from the plastic pellets to facilitate cleaning thereof within the Venturi chamber.

It is still another feature of this invention that compressed air is forced around the ionization pins to push ions into the flow of particulate material flowing past the ionization pins.

It is still another advantage of this invention that the use of compressed air to move ions into the flow of particulate material results in a higher population of individual pellets having negative ions attached to repel dust particles and facilitate cleaning of the particulate material.

It is yet another feature of this invention that the collected dust and debris cleaned from the particulate material is discharged from the compact dedusting apparatus through a conduit under negative pressure.

It is yet another advantage of this invention that the utilization of a discharge conduit under negative pressure allows a leak to occur in the discharge conduit without spilling the contents of the discharge conduit into the atmosphere.

It is a further advantage of this invention that the use of a discharge conduit under negative pressure makes this dedusting apparatus capable of use in a clean room.

It is a further object of this invention to provide a compact dedusting apparatus that has the capability of remote discharge for the collected dust and debris which is durable in construction, inexpensive of manufacture, carefree of maintenance, easy to assemble, and simple and effective in use.

These and other objects, features and advantages are accomplished according to the instant invention by providing a compact dedusting apparatus in which the air flow is induced through the housing by a vacuum generator mounted within the housing. The discharge of dust and debris can be passed through a conduit to a remote location without losing air flow velocity to facilitate the use of the compact dedusting apparatus within a clean room. The metering device is formed from stainless steel and mounted on a spring-loaded mounting plate to permit vertical movement of the metering device when a jam of the particulate material is encountered. The metering device can be driven by a low torque stepper motor operable at selectively variable speeds to control the flow rate of the particulate material. The discharge transition is formed with an enlarged cross-sectional area compared to the shape of the Venturi zone so that carryover pellets can be returned to the product flow instead of being lost with the dirty air discharge.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
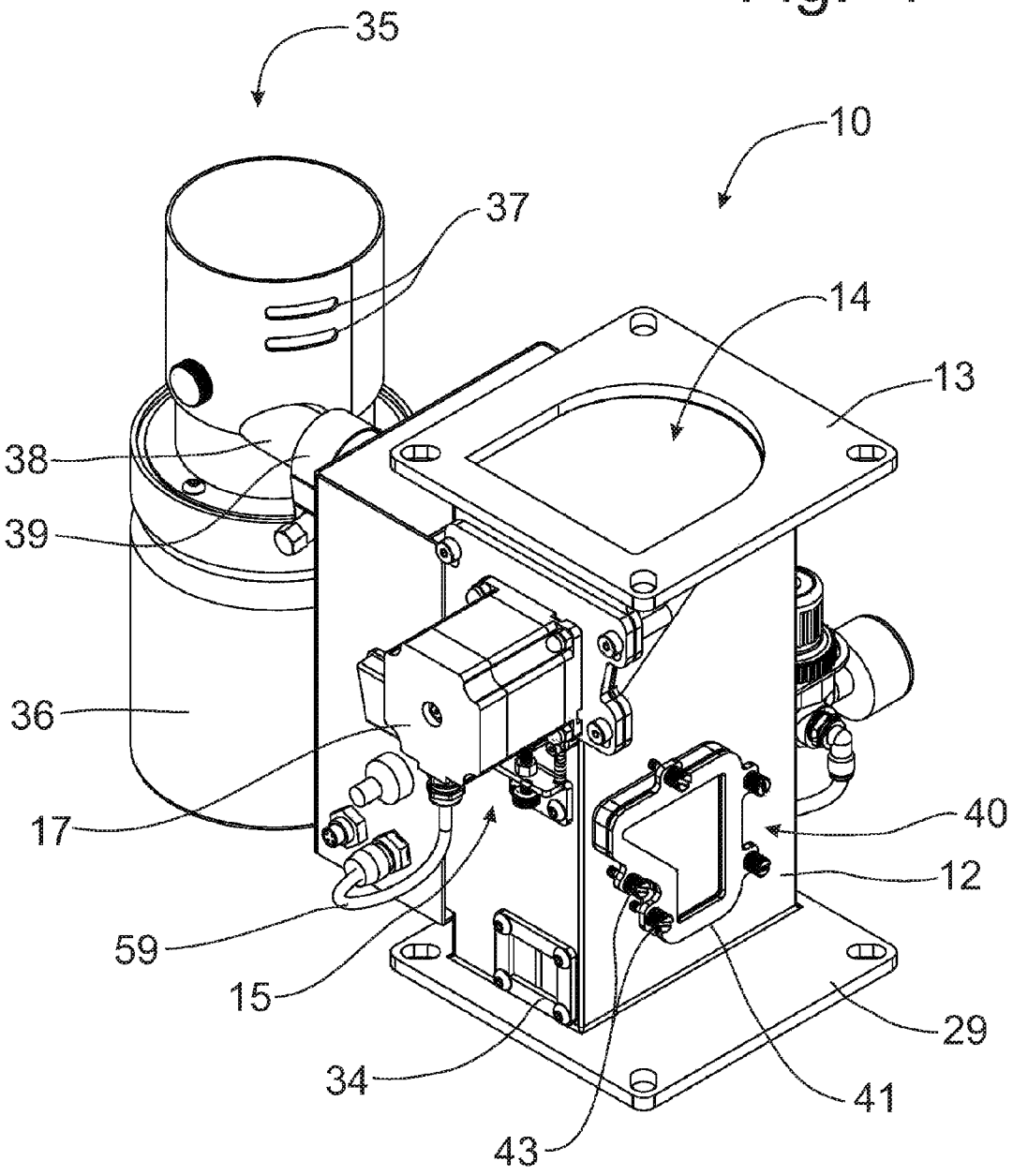
FIG. 1 is a perspective view of a compact dedusting apparatus incorporating the principles of the instant invention.

Referring to FIGS. 1-7, a compact dedusting apparatus incorporating the principles of the instant invention can best be seen. The compact dedusting apparatus utilizes the general dedusting techniques disclosed in U.S. Pat. No. 5,035,331, issued to Jerome I. Paulson on Jun. 3, 1991, including the passage of air through a Venturi zone where particulate material passes and air removes the dust and debris from the particulate material and the particulate material is subjected to an electro-magnetic ionization to induce negative ions on the particulate material to separate the pellets from the minute dust particles. However, these known contaminate removing techniques are structured in a different configuration that is generally depicted in PCT Patent Application No. PCT/KR2013/002924, filed on Apr. 8, 2013, by Joong Soon Kim, et al. Applicants, however, have improved on the Kim dedusting apparatus as will be described in greater detail below.

The dedusting apparatus 10 is generally rectangular in shape and configuration. The outer housing 12 is preferably formed of a durable material such as steel or cast iron, and can be formed by casting techniques. The top of the housing 12 is formed with an attachment flange 13 that can be connected to a supply of particulate material for introduction into the infeed opening 14 at the top of the housing 12. The infeed opening 14 is formed with a downwardly sloped, curved floor 14*a* that directs the flow of particulate material toward a metering device 15 that overlies the infeed port 16 formed in the floor 14*a*. The metering devices is a conical, fluted member 19 driven by a stepped, low torque motor 17 that is operable at selectively variable speeds to control the flow rate of particulate material through the infeed port 16. Preferably, the conical, fluted member 19 is formed from stainless steel so that the engagement thereof by the particulate material will not wear the member 19 and create additional dust passing through with the particulate material to be cleaned therefrom, as is the case with conventional conical, fluted members 19 formed from urethane.

The metered particulate material passes through the infeed port 16 into a first chamber 21 of the dedusting area 20. A series of ionizing pins 25 induce negative ions onto the individual pellets as the particulate material passes downwardly through a vertical portion 22 of the first chamber 21. The particulate material then encounters a downwardly sloped floor 23 that creates a sloped portion 24 of the first chamber 21 to direct the ionized particulate material into the vertical Venturi chamber 26 which oriented parallel to, but offset from the vertical portion 22 by the sloped portion 24. A flow of cleaning air is fed upwardly, as will be described in greater detail below, through the Venturi chamber 26 so that the air will lift the dust particles and the debris, which are both significantly lighter that the individual pellets of the particulate material, thereby removing the dust and debris and cleaning the particulate material. The dust and debris laden air is then discharged from the dedusting area 20, as will be described in greater detail below. The cleaned particulate material then passes downwardly by gravity through the product discharge opening 28 at the bottom of the housing 12.

The air flow through the Venturi chamber 26 is preferably generated by a vacuum generator 30 in the form of a line vac mounted in an electrical enclosure 31 supported from the housing 12 to create an air flow through a conduit 33 passing from the dedusting area 20 to the dust collector 35 offset from the dedusting apparatus 10. One skilled in the art will recognize that the location of the vacuum generator 30 could also be placed in the housing 12 depending on the configuration of the housing 12. The conduit 33 is in open communication with the Venturi chamber 26 at a discharge transition chamber 26*a* forming an upper portion of the Venturi chamber 26 to draw the dust and debris laden air from the Venturi chamber 26 into the conduit 33. This vacuum draws air into the Venturi chamber 26 from the product discharge opening 28 at the bottom of the housing 12.

Figure 3:
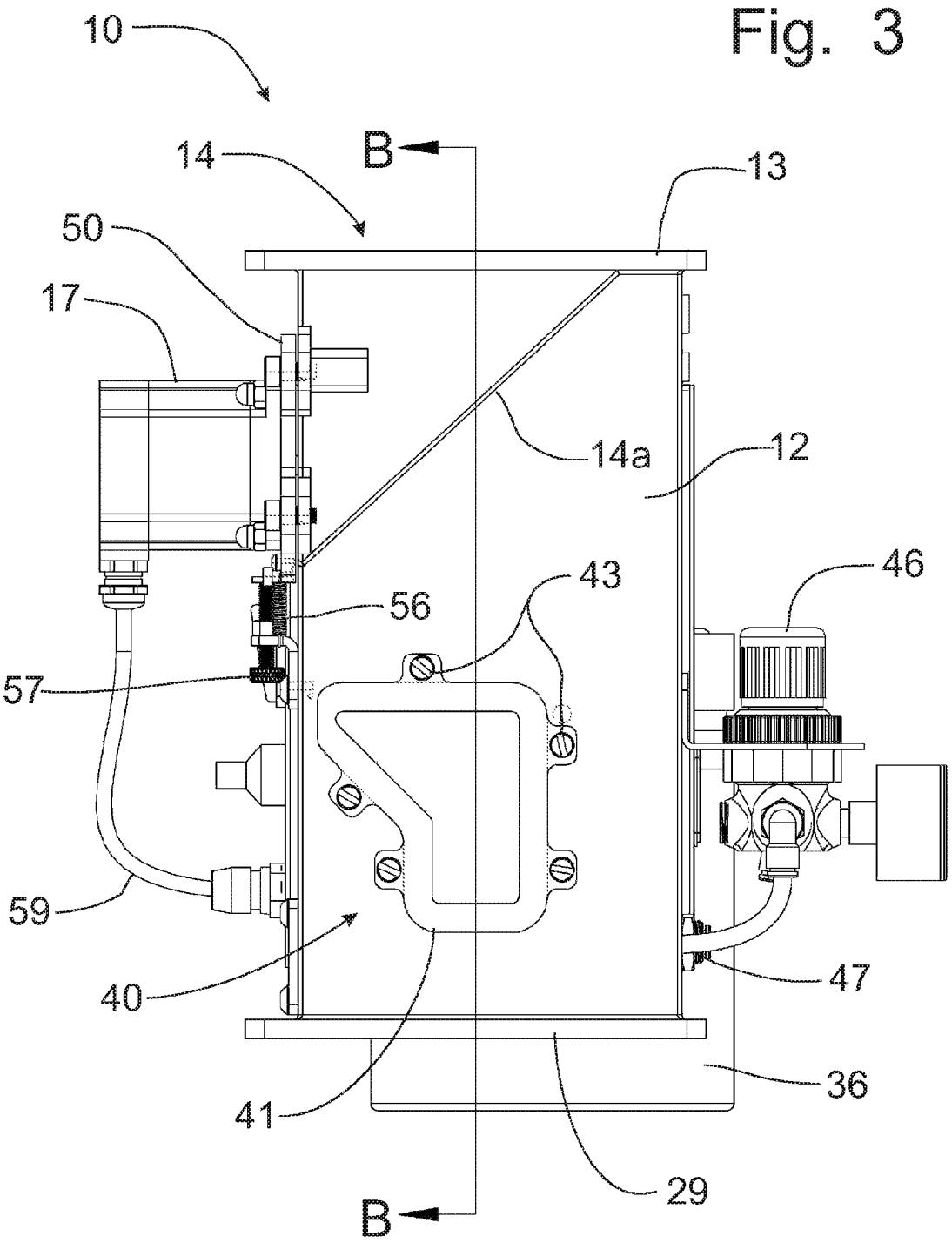
FIG. 3 is a front elevational view of the compact dedusting apparatus remote from the dust collection apparatus.
Figure 4:
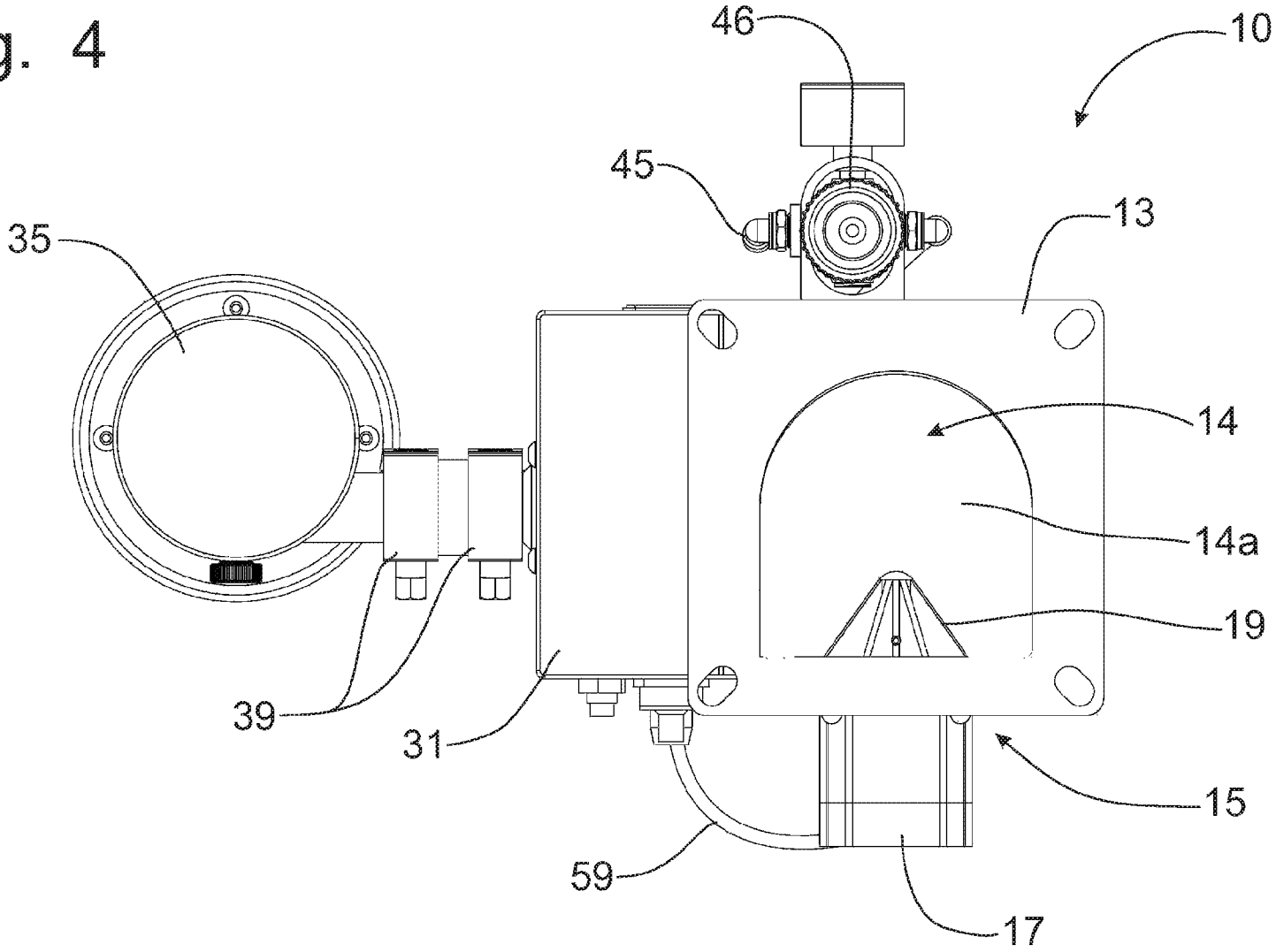
FIG. 4 is a top plan view of the compact dedusting apparatus.
Figure 5:
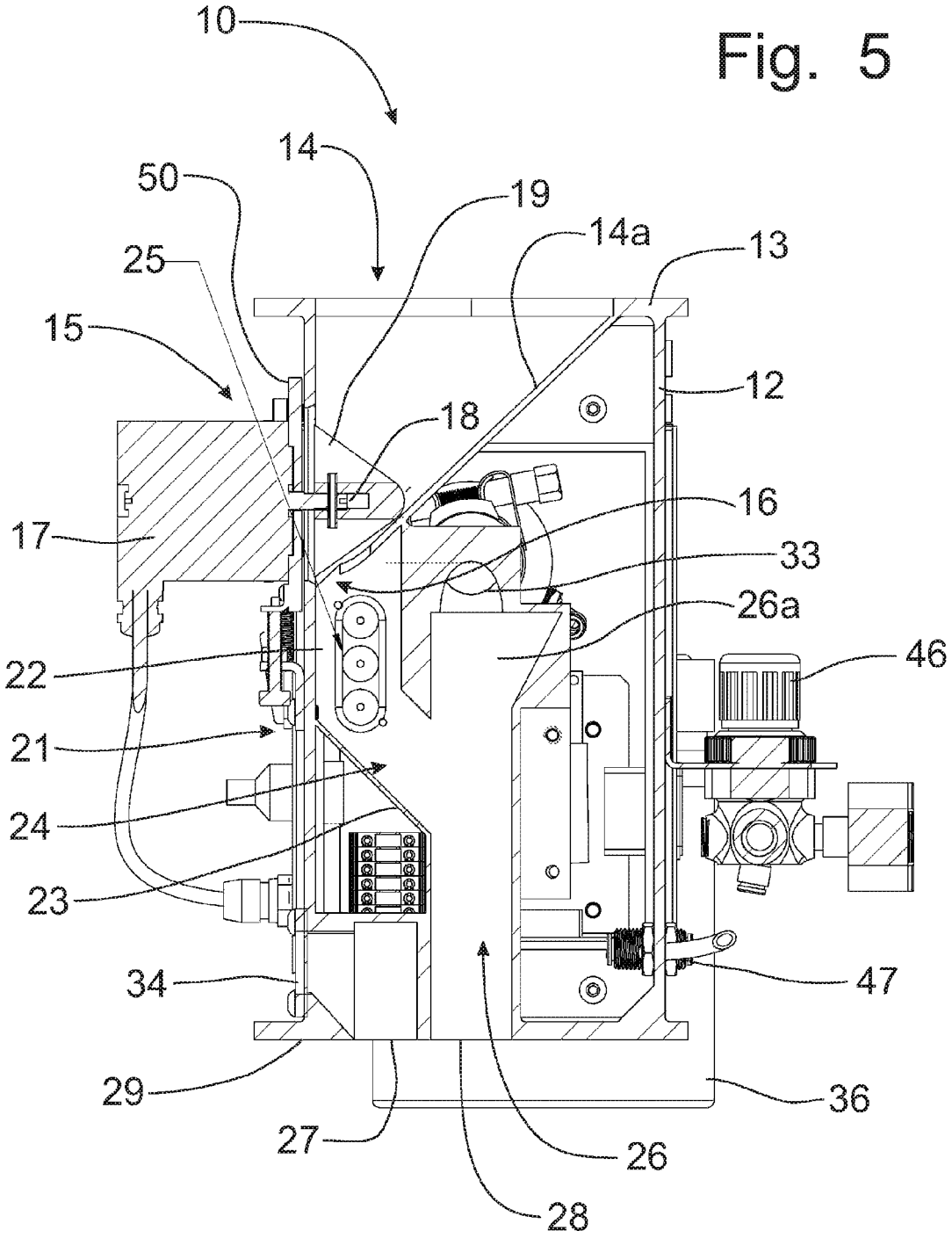
FIG. 5 is a cross-sectional view of the compact dedusting apparatus corresponding to lines A-A in FIG. 2.

The vacuum generator 30 receives compressed air for the operation thereof from a supply of compressed air connected to the compressed air connector 45 on the back side of the housing 12, as best seen in FIGS. 3-5. The compressed air flows through a pressure regulator 46 and is fed into a Wye connector port 47 in the housing 12. The Wye connector port 47 divides the flow of compressed air into two paths (not shown). One flow path delivers compressed air to the ionizer pins 25 where the compressed air flows around the ionizer pins 25 to force ions into the flow of particulate material passing through the vertical portion 22 of the first chamber 21. The second flow path delivers compressed air to the vacuum generator 30 which converts the relatively high pressure, low volume air flow into a relatively low pressure, high volume air flow through the vacuum generator 30 to draw air through the discharge conduit 33 by the generation of a vacuum.

Under certain circumstances relating to the use of the compact dedusting apparatus 10, the mounting flange 29 at the bottom of the housing 12 can be connected to a receiving device (not shown) that receives the cleaned product. The receiving device can seal against the mounting flange 29 which would prevent the vacuum generator 30 from drawing air through the product discharge opening 28. Utilization of the compact dedusting apparatus 10 in a clean room is a circumstance in which a receiving device is sealed against the lower mounting flange 29. In such circumstances, a filtered auxiliary port 34 is opened to allow air to be drawn through a clean air inlet port 27 positioned adjacent the product discharge opening 28 so that the air will enter the Venturi chamber 26 through the product discharge opening 28.

The upward movement of cleaning air through the Venturi chamber 26 is moving at a selected velocity, which can vary depending on the particulate material being cleaned, to carry the dust and debris upwardly while allowing the pellets to fall downwardly. Sometimes, however, pellets get entrained in the upward air flow, which is commonly referred to as carryover. Once the entrained air flow reaches the conduit 33, which has a smaller cross-sectional area than the Venturi chamber 26, the velocity of the air flow increases, which further entrains carryover pellets. To allow carryover pellets to drop back downwardly toward the product discharge opening 28, the discharge transition chamber 26*a* of the Venturi chamber 26 is widened, as is best seen in FIG. 5, to have a larger cross-sectional area than the Venturi chamber 26 below the sloped floor 23, which causes the velocity of the air flow to decrease and provides an opportunity for the carryover pellets to fall out of entrainment and drop toward the product discharge opening 28 before being drawn into the conduit 33.

Figure 6:
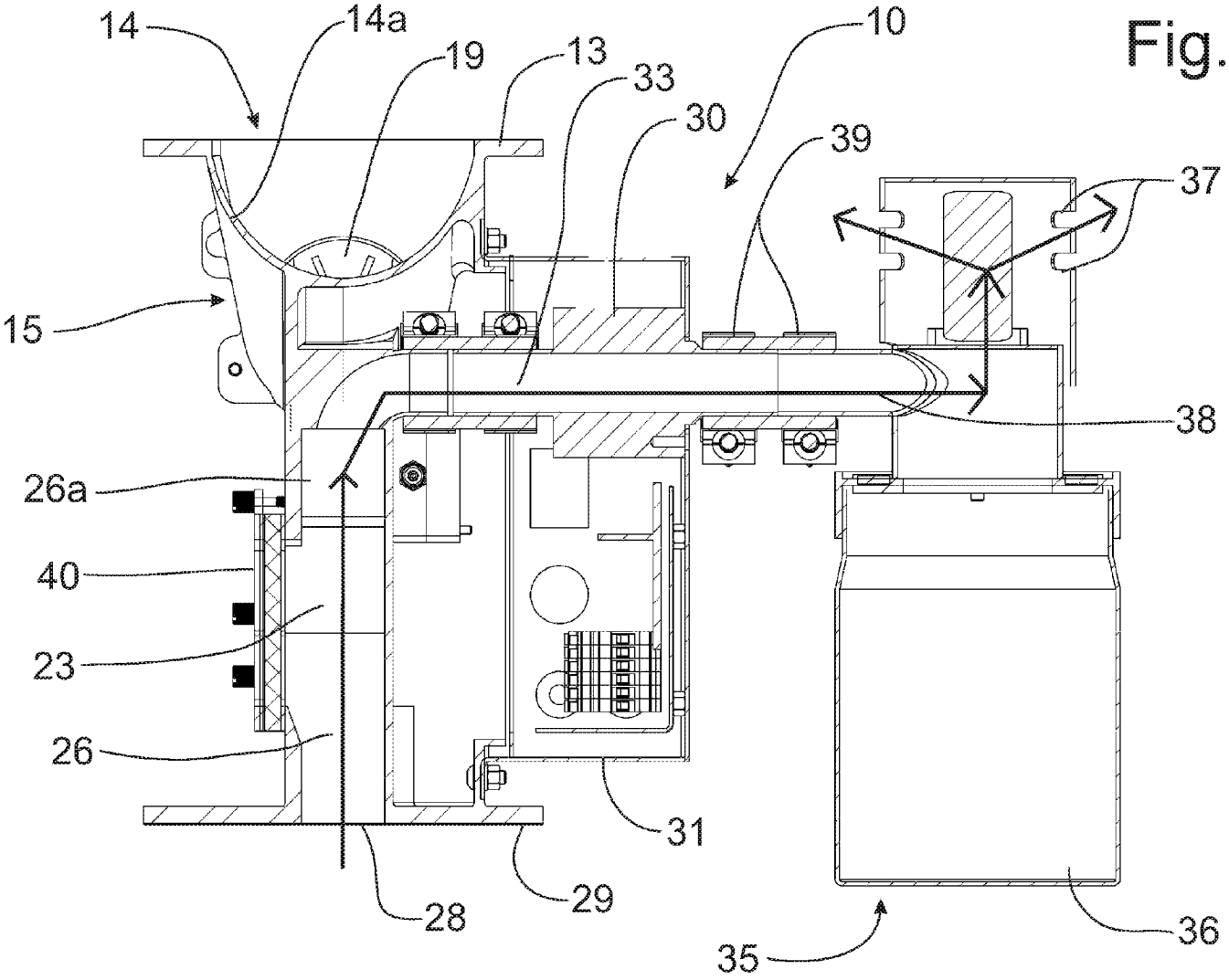
FIG. 6 is a cross-sectional view of the compact dedusting apparatus corresponding to lines B-B of FIG. 3.

As is best seen in FIG. 6, the conduit 33 extends beyond the vacuum generator 30 toward the dust collector 35. Although the dust collector 35 can be formed in different configurations, including filters, scrubbers and cyclones, among others, a compact dust collector 35 that spins the dust and debris laden air to separate the dust particles and debris therefrom is effective. The separated dust and debris is collected in a removable container 36 at the bottom of the dust collector 35, while the cleaned air is discharged through vents 37 at the top of the dust collector 35. In certain circumstances, such as clean rooms, discharging the cleaned air into atmosphere is not acceptable. In such circumstance, the dust collector 35 can be located at a remote location where the discharge of the cleaned air is acceptable, and the conduit 33 extended to the remote location.

When the vacuum generator 30 is located with the dust collector 35, as is known in the Kim dedusting apparatus depicted in PCT Patent Application No. PCT/KR2013/002924, the velocity of the air flow through the Venturi chamber 26 is adversely affected by placing the dust collector 35 and vacuum generator 30 at a remote location. Accordingly, the placement of the vacuum generator 30 within the electrical enclosure 31 enables the dust collector 35 to be remotely located without adversely changing the air flow through the dedusting apparatus 10. For this reason, the conduit 33 terminates at an appropriate distance outside of the electrical enclosure 31 so that the inlet conduit 38 of the dust collector 35 can be connected to the conduit 33 and secured by clamps 39. In circumstances where the dust collector 35 is to be remotely located, the clamps 39 are disconnected to allow the dust collector 35 to be appropriately positioned while a length of conduit extension (not shown) is interconnected between the conduit 33 and the inlet conduit 38 to carry the dust and debris laden air to the remotely located dust collector 35.

An additional improvement to the Kim compact dedusting apparatus as depicted in PCT Patent Application No. PCT/KR2013/002924 is the provision of a Plexiglas window 40 in the side of the housing corresponding to the location of the Venturi chamber 26. The Plexiglas window 40 is shaped to correspond to the shape of the sloped portion 24 of the first chamber and the lower vertical portion of the Venturi chamber 26 to permit the operator to observe the operation of the dedusting apparatus 10 so that appropriate adjustments can be made to the flow rate of the particulate material fed into the first chamber 21 or the rate of velocity of the air flow through the Venturi chamber 26 to provide an effective cleansing of the particulate material. The Plexiglas window 40 is mounted in a frame 41 and secured to and sealed against the housing 12 by fasteners 43. One skilled in the art will understand that a sensor (not shown) could be mounted on the window to detect particulate material collecting in the dedusting area 20, which can occur when the process consuming the cleaned particulate material passing through the product discharge opening 28 stops working.

Figure 2:
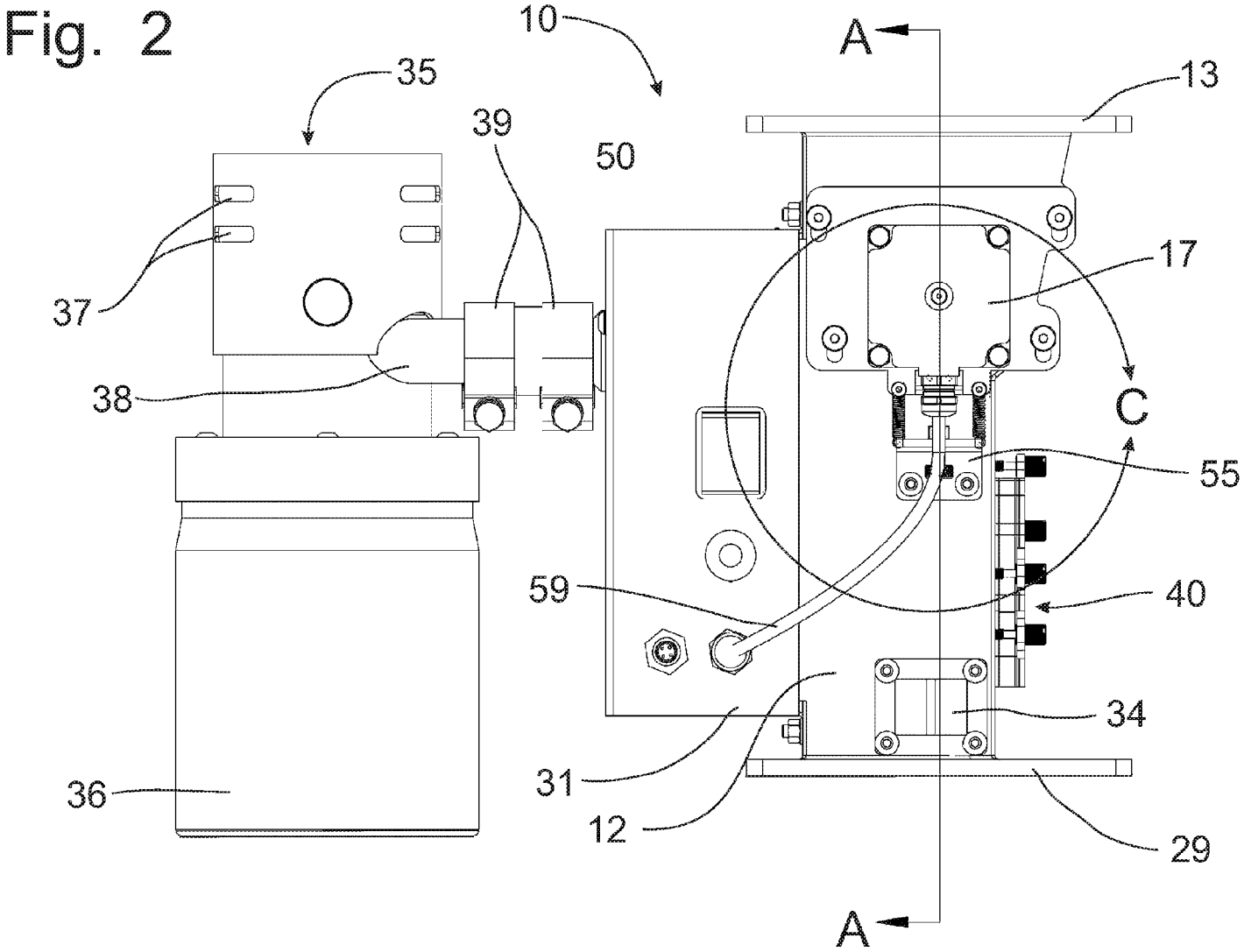
FIG. 2 is side elevational view of the compact dedusting apparatus shown in FIG. 1.
Figure 7:
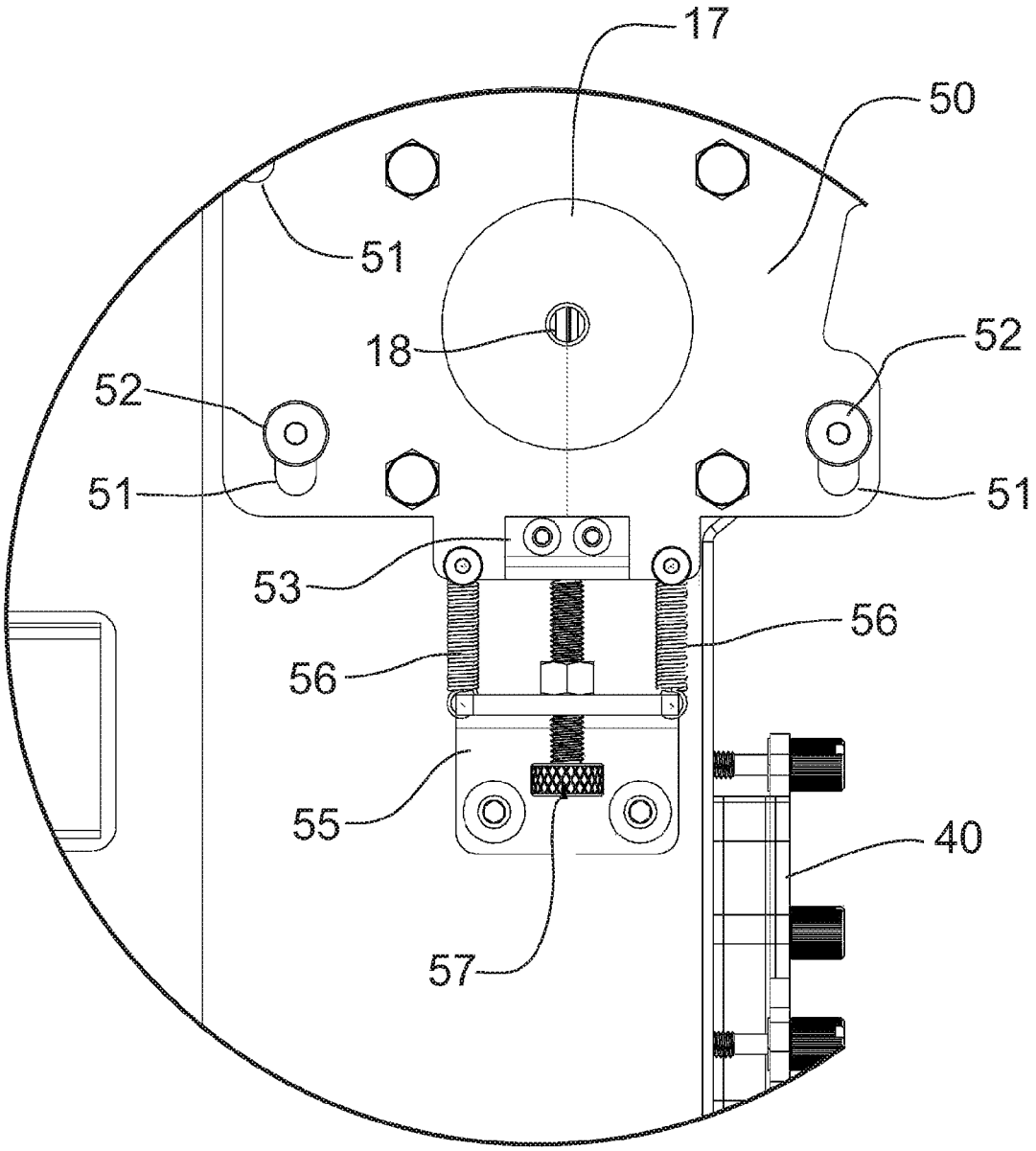
FIG. 7 is an enlarged front elevational view of the mounting plate on which the metering device is supported for vertical movement thereof, corresponding to circle C in FIG. 2.

As best seen in FIGS. 2, 3 and 7, the metering device 15 is mounted on the output shaft 18 of the low torque motor 17 to be rotatable therewith. The motor 17 is mounted to a movable mounting plate 50 located on the exterior of the housing 12. The mounting plate 50 is formed with vertically oriented slots 51 through which fasteners 53 extend to engage the housing 12. The fasteners 53 allow vertical movement of the mounting plate 50 relative to the housing 12 but do not allow the mounting plate 50 to part from the side of the housing 12. A stop bracket 55 is fixedly supported on the housing 12 below the mounting plate 50 and tension springs 56 interconnect the stop bracket 55 and the mounting plate 50 to bias the mounting plate 50 downwardly toward the stop bracket 55.

The stop bracket 55 receives a thumb screw 57 that projects upwardly therefrom to engage a stop tab 53 on the mounting plate 50. When the stop tab 53 hits the upward end of the thumb screw 57, the lowermost position of the mounting plate 50 is reached. Another purpose of the thumb screw 57 is to provide adjustment for the location of the lowermost position of the mounting plate 50 which in turn corresponds to the lowermost position of the conical, fluted member 19 relative to the sloped floor 14*a*. Since the conical fluted member 19 is formed from stainless steel, engagement between the conical fluted member 19 and the floor 14*a* should be avoided. However, the conical fluted member 19 can be located at the lowermost position thereof just slightly above the floor 14*a* so that particulate material cannot pass beneath the conical fluted member 19 and pass into the dedusting area 20 when the dedusting apparatus 10 is not being operated. Accordingly, the top mounting flange 13 can be connected to a supply of particulate material that fills the infeed opening from the metering device 15 to the top mounting flange 13 while the metering device 15 stops the flow of particulate material through the dedusting area when the dedusting apparatus is not being operated.

The upward movement of the mounting plate relative to the housing 12 permits the conical fluted member 19 to rise vertically when the particulate material is jammed within the infeed opening 14 to dislodge such jams and also to pass over pellets that may otherwise become lodged under one of the flutes of the conical fluted member 19 and be crushed or otherwise damaged by the stainless steel conical fluted member 19. In addition, providing the metering device 15 with the capability of moving vertically allows the motor 17 to be a stepped, low torque electric motor that can be powered through the power cord 59 connected to the electrical circuitry of the dedusting apparatus 10. If a stainless steel conical member were placed on the current configuration of the Uniceltec apparatus, the result would be chopped pellets causing irregularity in the cleaned product, more dust to be cleaned from the product, failed motors, broken shafts and jammed operation of the dedusting apparatus due to such failures.

In operation, the compact dedusting apparatus 10 is positioned to receive a supply of particulate material into the infeed opening 14 at the top of the housing 12. Such positioning could require that the upper mounting flange 13 being connected to the apparatus providing a supply of the particulate material. The metering device 15 is powered to rotate the conical fluted member 19 to control the flow of particulate material through the infeed port 16 and into the dedusting area 20. The particulate pellets are subjected to ionization by the ionization pins 25 located in the vertical portion 22 of the first chamber 21. The ionized pellets then land on the sloped floor 23 to guide the pellets into the Venturi chamber 26 where a flow of air coming upwardly through the product discharge opening 28 removes the dust particles and debris from the pellets so that the cleaned pellets can continue to fall by gravity downwardly and pass through the product discharge opening 28.

The dust and debris laden air continues to flow upwardly to a discharge conduit 33 located at the top of a discharge transition chamber 26*a* of the Venturi chamber 26. Between the lower vertical portion of the Venturi chamber 26 and the discharge conduit 33, the discharge transition chamber 26*a* of the Venturi chamber 26 expands in size and cross-sectional area so that the velocity of the air flow is reduced to allow an carryover pellets to drop out of entrainment in the air flow before moving into the discharge conduit 33. The dust and debris laden air continues through the vacuum generator 30 to the dust collector 35, which can be located at a remote location and connected to said conduit 33 by a supplemental conduit (not shown). Since the vacuum generator 30 is located in the electrical enclosure 31, the dust collector 35 can be positioned remotely from the dedusting apparatus 10 without deteriorating the flow of air through the Venturi chamber 26.

The conical fluted member 19 is formed from stainless steel to prevent wear due to engagement with particulate material, as is known with conventional urethane members. The metering device 15 is mounted for vertical movement by the mounting plate 50 which is spring-loaded by the tension springs 56 toward a lowermost position. An adjustment mechanism in the form of a stop bracket 55 with an adjustable thumb screw 57 received therein permits a selective adjustment of the lowermost position of the metering device 15 so that the stainless steel conical fluted member 19 will be appropriately located with respect to the curved sloped floor 14*a* of the infeed opening 14.

The upper mounting flange 13 is configured so that the upper mounting flange 13 does not overlie the infeed opening 14 and provide structure for particulate material to collect and detract from the operating efficiency of the dedusting apparatus 10. The housing 12 has an opening therein covered by a Plexiglas window 40 mounted in a frame 41 and secured to the housing 12 by fasteners 43 so that the operator can observe the operation of the dedusting area 20 and make operational adjustments as needed. When the lower mounting flange 29 is sealed against a receiving device (not shown) the flow of cleaning air can pass through a clean air inlet port 27 that extends from the side of the housing 12 to an opening in said lower mounting flange adjacent the product discharge opening 28 so that air can be drawn through the clean air inlet port 27 and then upwardly through the product discharge opening 28 to fill the Venturi chamber 26 and remove dust and debris from the particulate material.

It will be understood that changes in the details, materials, steps and arrangements of parts, which have been described and illustrated to explain the nature of the invention will occur to and may be made by those skilled in the art upon a reading of this disclosure within the principles of the scope of the invention. The foregoing description illustrates the preferred embodiment of the invention; however, concepts, as based upon the description may be employed in other embodiments without departing from the scope of the invention.

Accordingly, the following claims are intended to protect the invention broadly, as well as in the specific form shown.

Having thus described the invention, what is claimed is:

1. A dedusting apparatus for cleaning contaminates from particulate material, comprising:

a housing defining a dedusting area for removing contaminates from particulate material and having a product discharge opening;

a motor mounted on a mounting plate configured to be vertically movable relative to the housing, said mounting plate being engagable with an adjustable stop member that defines a lowermost position of said mounting plate;

an infeed opening located at an upper portion of said housing to receive a supply of particulate material, said infeed opening including a sloped floor to direct particulate material downwardly toward an infeed port;

a metering device located within said infeed opening and being operable to control the flow of particulate material through said infeed port, said metering device including a conical member formed from stainless steel and being mounted on an output shaft of said motor such that said conical member is vertically adjustable with said motor so that the lowermost position thereof can be located above said sloped floor of said infeed opening;

a Venturi chamber positioned to receive particulate material passing through said infeed port and to remove dust and debris from the particulate material by a flow of air passing upwardly through the product discharge opening into the Venturi chamber, while cleaned particulate material falls through the product discharge opening; and a discharge conduit positioned above the Venturi chamber to receive dust and debris laden air moving upwardly from said Venturi chamber, said discharge conduit moving said dust and debris laden air remotely from said dedusting area.

2. The dedusting apparatus of claim 1 wherein said stop member is a thumb screw mounted in a stop bracket affixed to said housing below said mounting plate, tension springs interconnect said mounting plate and said stop bracket to bias the position of said mounting plate toward engagement with said thumb screw.

3. The dedusting apparatus of claim 1 wherein said flow of air through said Venturi chamber is induced by a vacuum generator mounted in a fixed location relative to said dedusting apparatus, said vacuum generator being in flow communication with said discharge conduit to draw air from said product discharge opening through said Venturi chamber and into said discharge conduit.

4. The dedusting apparatus of claim 3 further comprising a discharge transition chamber in flow communication with and being located between said Venturi chamber and said discharge conduit, said discharge transition chamber having a larger cross-section area than the Venturi chamber below said discharge transition chamber and said discharge conduit above said discharge transition chamber so that said air flow reduces velocity before entering said discharge conduit.

5. The dedusting apparatus of claim 4 wherein said housing defines an auxiliary clean air port that can be opened selectively to provide a flow of air through the housing to exit through an opening adjacent said product discharge opening so that when said product discharge opening is sealed to prevent air to be drawn through said product discharge opening from externally of said housing, said auxiliary clean air port can be opened to provide a source of clean air from externally of said housing.

6. The dedusting apparatus of claim 1 wherein said dedusting area further includes a first chamber that includes a vertical portion and a sloped portion, said vertical portion being in flow communication with said infeed port to receive particulate material therefrom, said sloped portion including a sloped floor that engages the particulate material falling through said vertical portion and directs the particulate material laterally into said Venturi chamber.

7. The dedusting apparatus of claim 6 wherein said vertical portion of said first chamber includes ionizing pins mounted in a sidewall thereof to induce negative ions onto said particulate material to separate dust particles from pellets to facilitate the removal of said dust particles from said pellets in said Venturi chamber.

8. A dedusting apparatus for cleaning contaminates from particulate material, comprising:

a housing defining a dedusting area for removing contaminates from particulate material;

an infeed opening located at an upper portion of said housing to receive a supply of particulate material, said infeed opening including a sloped floor to direct particulate material downwardly toward an infeed port;

a metering device located within said infeed opening and being operable to control the flow of particulate material through said infeed port;

a Venturi chamber positioned to receive particulate material passing through said infeed port and to remove dust and debris from the particulate material by a flow of air passing upwardly through the product discharge opening into the Venturi chamber, while cleaned particulate material falls through the product discharge opening;

a discharge conduit positioned above the Venturi chamber to receive dust and debris laden air moving upwardly from said venture chamber, said discharge conduit moving said dust and debris laden air remotely from said dedusting area; and a discharge transition chamber located between said Venturi chamber and said discharge conduit and being in flow communication with both said Venturi chamber and said discharge conduit, said discharge transition chamber having a large cross-sectional area than either said Venturi chamber or said discharge conduit to create a drop in velocity of air flow from said Venturi chamber before entering said discharge conduit.

9. The dedusting apparatus of claim 8 wherein said flow of air through said Venturi chamber is induced by a vacuum generator mounted in a fixed location relative to said dedusting apparatus, said vacuum generator being in flow communication with said discharge conduit to draw air from said product discharge opening through said Venturi chamber and said discharge transition chamber and into said discharge conduit.

10. The dedusting apparatus of claim 9 wherein said housing defines an auxiliary clean air port that can be opened selectively to provide a flow of air through the housing to exit through an opening adjacent said product discharge opening so that when said product discharge opening is sealed to prevent air to be drawn through said product discharge opening from externally of said housing, said auxiliary clean air port can be opened to provide a source of clean air from externally of said housing.

11. The dedusting apparatus of claim 8 wherein said dedusting area further includes a first chamber that includes a vertical portion and a sloped portion, said vertical portion being in flow communication with said infeed port to receive particulate material therefrom, said sloped portion including a sloped floor that engages the particulate material falling through said vertical portion and directs the particulate material laterally into said Venturi chamber.

12. The dedusting apparatus of claim 11 wherein said vertical portion of said first chamber includes ionizing pins mounted in a sidewall thereof to induce negative ions onto said particulate material to separate dust particles from pellets to facilitate the removal of said dust particles from said pellets in said Venturi chamber.

13. The dedusting apparatus of claim 8 wherein said metering device includes a conical member formed from stainless steel and being vertically adjustable so that the lowermost position thereof can be located above said sloped floor of said infeed opening.

14. The dedusting apparatus of claim 13 wherein said conical member is mounted on the output shaft of a motor, said motor being mounted on a mounting plate configured to be vertically movable relative to the housing, said mounting plate being engagable with an adjustable stop member that defines a lowermost position of said mounting plate and, in turn, the corresponding lowermost position of said conical member.

15. The dedusting apparatus of claim 14 wherein said stop member is a thumb screw mounted in a stop bracket affixed to said housing below said mounting plate, tension springs interconnect said mounting plate and said stop bracket to bias the position of said mounting plate toward engagement with said thumb screw.

16. A dedusting apparatus for cleaning contaminates from particulate material, comprising:

a housing defining a dedusting area for removing contaminates from particulate material;

an infeed opening located at an upper portion of said housing to receive a supply of particulate material, said infeed opening including a sloped floor to direct particulate material downwardly toward an infeed port;

a metering device located within said infeed opening and being operable to control the flow of particulate material through said infeed port;

a Venturi chamber positioned to receive particulate material passing through said infeed port and to remove dust and debris from the particulate material by a flow of air passing upwardly through the product discharge opening into the Venturi chamber, while cleaned particulate material falls through the product discharge opening;

a discharge conduit positioned above the Venturi chamber to receive dust and debris laden air moving upwardly from said venture chamber, said discharge conduit moving said dust and debris laden air remotely from said dedusting area; and a vacuum generator mounted in a fixed location relative to said dedusting apparatus, said vacuum generator being in flow communication with said discharge conduit to draw air from said product discharge opening through said Venturi chamber and into said discharge conduit;

a dust collector in flow communication with said discharge conduit externally of said vacuum generator, said dust collector being positionable at a desired location by extending said discharge conduit to said dust collector without deteriorating the velocity of the air flow through said Venturi chamber; and a discharge transition chamber in flow communication with and being located between said Venturi chamber and said discharge conduit, said discharge transition chamber having a larger cross-section area than the Venturi chamber below said discharge transition chamber and said discharge conduit above said discharge transition chamber so that said air flow reduces velocity before entering said discharge conduit.

17. The dedusting apparatus of claim 16 wherein said housing defines an auxiliary clean air port that can be opened selectively to provide a flow of air through the housing to exit through an opening adjacent said product discharge opening so that when said product discharge opening is sealed to prevent air to be drawn through said product discharge opening from externally of said housing, said auxiliary clean air port can be opened to provide a source of clean air from externally of said housing.

18. The dedusting apparatus of claim 16 wherein said metering device includes a conical member formed from stainless steel and being vertically adjustable so that the lowermost position thereof can be located above said sloped floor of said infeed opening.

19. The dedusting apparatus of claim 18 wherein said conical member is mounted on the output shaft of a motor, said motor being mounted on a mounting plate configured to be vertically movable relative to the housing, said mounting plate being engagable with an adjustable stop member that defines a lowermost position of said mounting plate and, in turn, the corresponding lowermost position of said conical member.

20. The dedusting apparatus of claim 19 wherein said stop member is a thumb screw mounted in a stop bracket affixed to said housing below said mounting plate, tension springs interconnect said mounting plate and said stop bracket to bias the position of said mounting plate toward engagement with said thumb screw.

21. A dedusting apparatus for cleaning contaminates from particulate material, comprising:

a housing defining a dedusting area for removing contaminates from particulate material and having a product discharge opening;

an infeed opening located at an upper portion of said housing to receive a supply of particulate material, said infeed opening including a sloped floor to direct particulate material downwardly toward an infeed port;

a Venturi chamber positioned to receive particulate material passing through said infeed port and to remove dust and debris from the particulate material by a flow of air passing upwardly through the product discharge opening into the Venturi chamber, while cleaned particulate material falls through the product discharge opening;

at least one ionizing pin mounted in a sidewall of said housing below said infeed port to induce negative ions onto said particulate material passing through said infeed port to facilitate the separation of dust particles from pellets to facilitate the removal of said dust particles from said pellets in said Venturi chamber; and a discharge conduit positioned above the Venturi chamber to receive dust and debris laden air moving upwardly from said Venturi chamber, said discharge conduit moving said dust and debris laden air remotely from said dedusting area.

22. The dedusting apparatus of claim 21 further comprising a metering device located within said infeed opening and being operable to control the flow of particulate material through said infeed port, said metering device including a conical member formed from stainless steel and being vertically adjustable so that the lowermost position thereof can be located above said sloped floor of said infeed opening.

23. The dedusting apparatus of claim 22 wherein said conical member is mounted on the output shaft of said motor, said motor being mounted on a mounting plate configured to be vertically movable relative to the housing, said mounting plate being engagable with an adjustable stop member that defines a lowermost position of said mounting plate and, in turn, the corresponding lowermost position of said conical member.

24. The dedusting apparatus of claim 21 wherein said flow of air through said Venturi chamber is induced by a vacuum generator mounted in a fixed location relative to said dedusting apparatus, said vacuum generator being in flow communication with said discharge conduit to draw air from said product discharge opening through said Venturi chamber and said discharge transition chamber and into said discharge conduit.

25. The dedusting apparatus of claim 24 wherein said housing defines an auxiliary clean air port that can be opened selectively to provide a flow of air through the housing to exit through an opening adjacent said product discharge opening so that when said product discharge opening is sealed to prevent air to be drawn through said product discharge opening from externally of said housing, said auxiliary clean air port can be opened to provide a source of clean air from externally of said housing.

* * * * *